US009335679B2

(12) United States Patent
Tanaka et al.

(10) Patent No.: US 9,335,679 B2
(45) Date of Patent: May 10, 2016

(54) IMAGE FORMING APPARATUS, IMAGE FORMING METHOD, AND NON-TRANSITORY COMPUTER READABLE MEDIUM STORING CONTROL PROGRAM

(71) Applicant: Konica Minolta, Inc., Tokyo (JP)

(72) Inventors: Toshiaki Tanaka, Toyokawa (JP); Yasuhiro Ishihara, Toyohashi (JP); Kosuke Masumoto, Hachioji (JP); Satoshi Chikazawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/557,971

(22) Filed: Dec. 2, 2014

(65) Prior Publication Data

US 2015/0168886 A1 Jun. 18, 2015

(30) Foreign Application Priority Data

Dec. 18, 2013 (JP) ..... 2013-260789

(51) Int. Cl.
*G03G 15/20* (2006.01)
*G03G 15/00* (2006.01)

(52) U.S. Cl.
CPC ..... *G03G 15/2039* (2013.01); *G03G 15/5025* (2013.01)

(58) Field of Classification Search
CPC ..... G03G 15/2039; G03G 15/2046; G03G 15/5025
See application file for complete search history.

(56) References Cited

U.S. PATENT DOCUMENTS

| | | | | |
|---|---|---|---|---|
| 2009/0196644 | A1 | 8/2009 | Funatsu | |
| 2012/0114358 | A1 | 5/2012 | Sugiyama | |
| 2012/0315060 | A1 | 12/2012 | Sugiyama | |
| 2013/0045021 | A1 * | 2/2013 | Yoshioka et al. | 399/69 |

FOREIGN PATENT DOCUMENTS

| | | | |
|---|---|---|---|
| JP | H06-035365 | A | 10/1994 |
| JP | H07-314783 | A | 12/1995 |
| JP | 2009-181065 | A | 8/2009 |

(Continued)

OTHER PUBLICATIONS

Notification of Reasons for Refusal for corresponding Japanese Application No. 2013-260789; and translation.

(Continued)

*Primary Examiner* — David Bolduc
*Assistant Examiner* — Barnabas Fekete
(74) *Attorney, Agent, or Firm* — Lucas & Mercanti, LLP

(57) ABSTRACT

An image forming apparatus includes an image forming section to form a toner image and transfer the toner image to a recording medium and a fixing section to heat the recording medium transferred with the toner image and further an image analyzing section to extract a density value or a size value of an imaging object included in an image, and a temperature determining section to determine a minimum fixing temperature based on the density value or size value of the imaging object included in a page image. The temperature determining section determines the minimum fixing temperature to be lower when a highest one of the density values is lower than when the highest value is higher or determines the minimum fixing temperature to be lower when a largest one of the size values is smaller than when the largest size value is larger.

22 Claims, 7 Drawing Sheets

(56) References Cited

FOREIGN PATENT DOCUMENTS

| | | | |
|---|---|---|---|
| JP | 2012-118496 | A | 6/2012 |
| JP | 2013-041118 | A | 2/2013 |
| JP | 2014-056036 | A | 3/2014 |

OTHER PUBLICATIONS

Translation (Abstracts Only) of all the Japanese references: JP2013-041118A, JPH06-035365A, JPH07-314783A and JP2014-058036A.

* cited by examiner

IMAGE FORMING APPARATUS, IMAGE FORMING METHOD, AND NON-TRANSITORY COMPUTER READABLE MEDIUM STORING CONTROL PROGRAM

CROSS-REFERENCE TO RELATED APPLICATIONS

This application is based upon and claims the benefit of priority from the prior Japanese Patent Application No. 2013-260789 filed on Dec. 18, 2013, the entire contents of which are incorporated herein by reference.

BACKGROUND OF THE INVENTION

1. Field of the Invention

The present invention relates to an image forming apparatus configured to carry a toner image on a recording medium and then fix the toner image to the recording medium by heat to form an image and, more particularly, to an image forming apparatus arranged to optimize input energy to a fixing section according to conditions of output images.

2. Description of Related Art

An image forming apparatus using toner is conventionally configured to form a toner image and then transfer the toner image to a recording medium such as a printing sheet. The toner image transferred to the recording medium is thereafter fixed to the recording medium by heating. Meanwhile, in recent years, the image forming apparatus has been demanded for high-level energy saving. Herein, energy to be consumed by a fixing section arranged to heat a recording medium carrying thereon a toner image accounts for no small percentage of the total energy used by the image forming apparatus. Therefore, the image forming apparatus has strongly been demanded for energy saving of the fixing section.

One example of an image forming apparatus configured with energy saving of a fixing section is disclosed in Japanese patent application publication No. 2012-118496. In this image forming apparatus, a target fixing temperature in fixing processing is set changeable. This apparatus also includes a function of making gray-scale (gradation) processing of image information in image processing for image formation. The target fixing temperature is changed based on whether or not the image information to be subjected to image formation includes a content needing to undergo halftone processing. Furthermore, since the gray-scale processing includes various types, the target fixing temperature is changed according to the type of the gray-scale processing to be executed. The publication says this enables setting a best fixing temperature per one recording medium during continuous printing. The publication also says there is no need for selection of a specific mode at that time neither a huge amount of information.

However, the aforementioned image forming apparatus disclosed in the publication has the following problems. For energy saving of the fixing section, it is essential not to increase the fixing temperature beyond a required minimum temperature. The required minimum temperature is mainly determined by an amount of toner present on the recording medium. Parameters related to an image to be formed and most likely to influence the toner amount are density and size of an object to be drawn (a drawing object). Meanwhile, the image forming apparatus in the publication basically uses, as index for determining the target fixing temperature, the presence/absence of halftone processing and the type of gray-scale processing. However, those parameters are not always reflected adequately in the amount of toner on the recording medium. Thus, the image forming apparatus still has a room for improvement in optimization of the fixing temperature for the purpose of energy saving.

The present invention has been made to solve the above problems and has a purpose to provide an image forming apparatus configured to set a target fixing temperature adequately reflecting contents of an image to be formed, thereby forming an appropriate image while optimizing input energy to a fixing section.

SUMMARY OF THE INVENTION

To achieve the above purpose, one aspect of the invention provides an image forming apparatus including: an image forming section configured to form a toner image based on image data and transfer the formed toner image to a recording medium; a fixing section configured to heat the recording medium to which the toner image has been transferred in the image forming section to fix the toner image; an image analyzing section configured to extract, from the image data of the image to be formed in the image forming section, at least one of a density value and a size value of each of imaging objects included in the image; and a temperature determining section configured to determine a minimum fixing temperature of the fixing section for the recording medium transferred with a page image which is an image corresponding to one page of the recording medium to be formed in the image forming section, the minimum fixing temperature being determined based on the extracted density values or size values of the imaging objects included in the page image. Herein, the temperature determining section is configured to perform, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger.

In this image forming apparatus, an image is formed with the target fixing temperature defined by the minimum fixing temperature determined by the temperature determining section. Specifically, the temperature of the fixing section during image formation is set to a temperature equal to or higher than the minimum fixing temperature. For a page image including imaging objects having small maximum values of density value and size value, image formation is conducted with the minimum fixing temperature set lower. This is because those imaging objects are less likely to cause fixing failures even at a low fixing temperature. This reduces energy consumption in the fixing section. On the other hand, for a page image including imaging objects having large maximum values of density value and size value, image formation is conducted with the minimum fixing temperature set higher. This is because those drawing objects are likely to cause fixing failures at a low fixing temperature.

Another aspect of the invention provides a method for forming an image, including forming a toner image based on image data, transferring the formed toner image to a recording medium, and heating the recording medium to which the toner image has been transferred to fix the toner image, the method including: an image analyzing step of extracting, from the image data of the image to be formed, at least one of a density value and a size value of each of imaging objects included in the image; and a temperature determining step of determining a minimum fixing temperature for the recording medium transferred with a page image which is an image corresponding to one page of the recording medium to be formed, based on the extracted density values or size values of the imaging objects included in the page image, the temperature determining step including, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger.

Still another aspect of the invention provides a non-transitory computer readable medium storing a control program to control an image data processor of an image forming apparatus configured to form a toner image based on image data, transfer the formed toner image to a recording medium, and heat the recording medium having the transferred toner image to fix the toner image to execute: an image analyzing process of extracting, from the image data of the image to be formed, at least one of a density value and a size value of each of imaging objects included in the image; and a temperature determining process of determining a minimum fixing temperature for the recording medium transferred with a page image which is an image corresponding to one page of the recording medium to be formed, based on the extracted density values or size values of the imaging objects included in the page image, the temperature determining process including, based on the density value or the size value of each of the drawing objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger.

DESCRIPTION OF EMBODIMENTS

Figure 1:
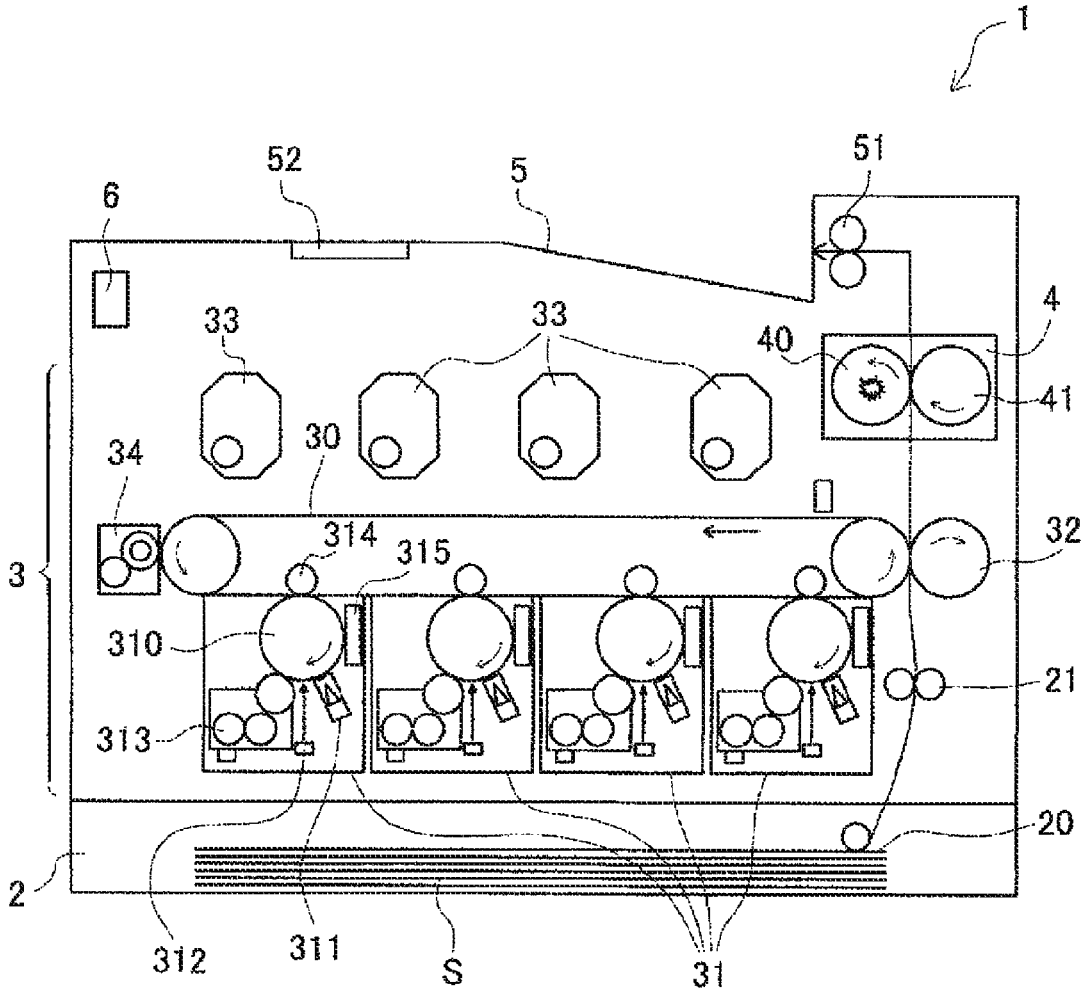
FIG. 1 is a sectional view of an entire structure of an image forming apparatus in an embodiment.

A detailed description of a preferred embodiment of the present invention will now be given referring to the accompanying drawings. In the present embodiment, the invention is applied to an image forming apparatus 1 shown in FIG. 1. The image forming apparatus 1 in FIG. 1 includes a sheet feeding section 2, an image forming section 3, and a fixing section 4. The sheet feeding section 2 is configured to store recording mediums S such as printing sheets to be subjected to image formation in the image forming section 3 and feed the recording mediums S one by one. The image forming section 3 is configured to form a toner image and transfer this toner image to a recording medium S fed from the sheet feeding section 2. The fixing section 4 is configured to heat the recording medium S to which the toner image has been transferred, thereby fixing the toner image to the recording medium S. The image forming apparatus 1 is further provided with a sheet output tray 5 on which the recording medium S having passed through the fixing section 4 is stacked.

The image forming section 3 will be further explained. The image forming section 3 includes an intermediate transfer belt 30 and four image forming units 31. The four image forming units 31 are identical in structure to each other except for toner colors to be used. Each of the image forming units 31 includes a photoconductor 310, a charger 311, an exposer 312, a developer 313, a primary transfer roller 314, and a photoconductor cleaner 315. The image forming section 3 is further provided with secondary transfer rollers 32.

Accordingly, the apparatus is arranged to form a toner image on each photoconductor 310 and then transfer the toner image to the intermediate transfer belt 30 by corresponding the primary roller 314. The toner image transferred to the intermediate transfer belt 30 is then transferred onto the recording medium S by the secondary transfer rollers 32. The above formation of the toner image on the photoconductor 310 is performed in such a manner that the exposer 312 draws a latent image based on image data to the surface of the photoconductor 310 having been charged by the charger 311, and the developer 313 develops the latent image to form a toner image. The image forming section 3 is further provided with four toner hoppers 33 and a belt cleaner 34.

The fixing section 4 includes a heating roller 40 and a pressure roller 41. In the fixing section 4, the heating roller 40 and the pressure roller 41 are placed in pressure contact with each other, so that each recording medium S is caused to pass through a nip formed between the heating roller 40 and the pressure roller 41. The sheet feeding section 2 includes a pickup roller 20 and a timing roller 21. Accordingly, each recording medium S stored in the sheet feeding section 2 is fed out one by one separately by the pickup roller 20. Further, the recording medium S is fed out to reach the secondary transfer roller 32 in sync with the timing of forming the toner image.

The image forming apparatus 1 is still further provided with sheet output rollers 51 to discharge the recording medium S fed out of the fixing section 4 onto the sheet output tray 5, and a control panel 52 on which a command is input by a user and information is displayed to a user. Besides the above, the image forming apparatus 1 is also provided with a controller 6. This controller 6 includes a function of controlling the temperature of the fixing section 4, as mentioned later, in addition to a function of overall controlling the entire image forming apparatus 1.

When the image forming apparatus 1 is to be operated for image formation, the intermediate transfer belt 30 is moved counterclockwise in FIG. 1, while the photoconductors 310 are each rotated clockwise. In each of the image forming units 31, the charger 311, the exposer 312, and the developer 313 act to form a toner image on the photoconductor 310. The thus formed toner images are superimposed on the intermediate transfer belt 30 by respective primary transfer rollers 314. On the other hand, the recording medium S fed out from the sheet feeding section 2 reaches the secondary transfer rollers 32. Herein, the timing of arrival of the recording medium S at the secondary transfer rollers 32 and the timing of arrival of the superimposed toner image at the secondary transfer rollers 32 are synchronized. Accordingly, the superimposed toner image is transferred onto the recording medium S.

The temperature of the heating roller 40 in the fixing section 4 rises in advance up to a predetermined fixing set temperature. Thus, the superimposed toner image on the recording medium S is fixed to the recording medium S when passing through the fixing section 4. The recording medium S having passed through the fixing section 4, that is, the recording medium S on which an image has been formed, is stacked onto the sheet output tray 5. The above operation of the image forming apparatus 1 is performed as part of overall control by the controller 6.

The temperature control of the heating roller 40 in the fixing section 4 will be explained below. In the image forming apparatus 1, basically, the temperature rising of the heating roller 40 is suppressed to a minimum in order to save power consumption of the fixing section 4. The control system of the image forming apparatus 1 to execute this temperature control is configured as shown in a block diagram in FIG. 2. The control system in FIG. 2 includes, centering around a CPU 61, an information control circuit 62, an image processing circuit 63, a drive control circuit 64, a power supply circuit 65, and others.

Further, the information control circuit 62 is provided with an I/F 67 to allow connection with an external information device. The information control circuit 62 is further connected to the control panel 52, sensors 48, and a storing section 49. The sensors 48 are sensors and the like to obtain various parameters to be used for image formation. Examples of the sensors 48 are an image sensor for detecting a toner image on the intermediate transfer belt 30 and an environmental factor sensor to obtain environmental factors. The storing section 49 stores image data to be printed and also various information needed for image formation. The drive control circuit 64 is connected to the image forming units 31 one for each color, the secondary transfer rollers 32, the fixing section 4, and the sheet feeding and output sections 2 and 51. The CPU 61 controls each of those sections or parts. The controller 6 shown in FIG. 1 includes the CPU 61, the information control circuit 62, the image processing circuit 63, the drive control circuit 64, the power supply circuit 65, the I/F 67, and the storing section 49.

In the image forming apparatus 1, the target temperature of the heating roller 40 is set for each of the recording mediums S. This is because the contents of images to be formed are different by respective recording mediums S and thus the required minimum fixing temperatures are different according to the image contents. In general, a minimum temperature required for fixing toner (hereinafter, "reference fixing temperature") is determined according to the type of toner. In a normal case, image formation is performed by maintaining the heating roller 40 at the reference fixing temperature or higher irrespective of the image contents. The reference fixing temperature is a temperature designated to enable fixation without problem even when the contents of images are most difficult to fix.

However, even when the temperature of the heating roller 40 is below the reference fixing temperature, there are cases where the toner can be fixed without problem according to the image contents. To be concretely, when an image consists of a small sized figure(s) or when an image is low in toner density, that is, the lightness of the image is high, the toner can be fixed at a low temperature to a certain degree. This is because the amount of toner in the corresponding figure(s) and region(s) is not so large and thus the toner can be fixed even at a relatively low temperature.

In the image forming apparatus 1 in the present embodiment, therefore, the temperature of the heating roller 40 is set different according to the content of an image to be formed in each recording medium S. Thus, the reference fixing temperature is not always used and a lower fixing temperature than the reference fixing temperature may be used depending on the image content. This can save power consumption of the fixing section 4. Concretely, at the time of receiving a print job, it is determined what fixing temperature to set to perform the image formation of the relevant print job. This determination is conducted for each page included in the relevant print job. It is to be noted that "at the time of receiving a print job" represents the time when the information control circuit 62 in FIG. 2 receives a print job from the external information device via the I/F 67. Upon receipt of the print job, the PDL (page-description language) data of the image to be formed in the relevant print job is stored in the storing section 49.

A basic concept of determining a fixing temperature per page will be explained. In the image forming apparatus 1 in the present embodiment, this determination is performed based on the PDL data. In the PDL data, the content of each drawing object included in an image of a page targeted for printing. Herein, the drawing object represents an image element such as characters, ruled lines, photographs, and graphics, included in an image to be printed. To appropriately fix toner images of those drawing objects, the fixing temperature of the fixing section 4 needs to be the minimum fixing temperature or higher according to sizes and densities of the toner images.

In the image forming apparatus 1, therefore, the minimum fixing temperature is determined for each size or each density of the drawing objects. Specifically, the storing section 49 in FIG. 2 stores in advance a size-temperature table (Table 1) and a density-temperature table (Table 2).

The size-temperature table (Table 1) is a table defining a relationship between size and minimum fixing temperature for imaging objects by line-drawing such as characters, symbols, and ruled lines (hereinafter, referred to as "line-drawing objects"). Herein, the size represents the thickness of a line. Even for a table plotted with ruled lines, the size indicates the thickness of a ruled line constituting the table, not a horizontal and vertical size of the entire table. For characters and symbols, the size indicates the thickness of a line forming them. As an alternative, the size may be defined by the diameter of a maximum inscribed circle of a printing region, instead of the line thickness.

TABLE 1

| Size (Line Thickness) | Minimum Fixing Temperature |
|---|---|
| 0.05 mm or less | Very low (Reference fixing temperature - 15° C.) |
| 0.05 to 0.2 mm | Low (Reference fixing temperature - 10° C.) |
| 0.2 to 0.8 mm | Slight low (Reference fixing temperature - 5° C.) |
| 0.8 mm or more | High (Reference fixing temperature as-is) |

In Table 1, the minimum fixing temperature is set lower for a smaller size (upper column), for the reason that a line-drawing object consisting of thin lines has no portion on which a large amount of toner concentrates and thus can be fixed at a relatively low temperature. In contrast, the minimum fixing temperature is set higher for a larger size (lower column). From the above explanation, 'size' in the present specification represents line thickness. Vertical and horizontal size of a table or a picture is referred to as 'dimension'.

TABLE 2

| Toner Density | Minimum Fixing Temperature |
|---|---|
| 63 or less/255 | Very low |
| 64 to 127/255 | Low |
| 128 to 191/255 | Slight low |
| 192 or more/255 | High |

The density-temperature table (Table 2) is a table defining a relationship between density and minimum fixing temperature for picture imaging objects such as photographs and graphics, each having a filled-in region (hereinafter, referred to as "picture objects"). Herein, the density represents toner density. That is, there is an inverse relationship between the degree of density (high/low) and the degree of lightness (high/low). The terms "Very Low", "Low", "Slight Low", and "High" are the same in meaning as those in Table 1.

In Table 2, the minimum fixing temperature is set to lower for a lower density (higher lightness, upper column), for the reason that a picture consisting of lower density regions has a small toner amount per area and thus can be fixed at a relatively low temperature. In contrast, the minimum fixing temperature is set to higher for a higher density (lower lightness, lower column).

In Tables 1 and 2, the minimum fixing temperature in each condition is expressed by a difference from the reference fixing temperature, but may be designated by a fixing temperature itself. In Table 1, the minimum fixing temperature is defined at four levels by three thresholds of the line thickness. The four levels of the minimum fixing temperatures are one level corresponding to the reference fixing temperature and three levels corresponding to the fixing temperatures lower than the reference fixing temperature. In Table 2, similarly, the minimum fixing temperature is defined at four levels by three thresholds of the toner density. However, the number of levels of minimum fixing temperatures in Table 1 and Table 2 are not limited to "4". The present invention is valid as long as the number of levels is at least two (the number of thresholds is one) or more.

Figure 2:
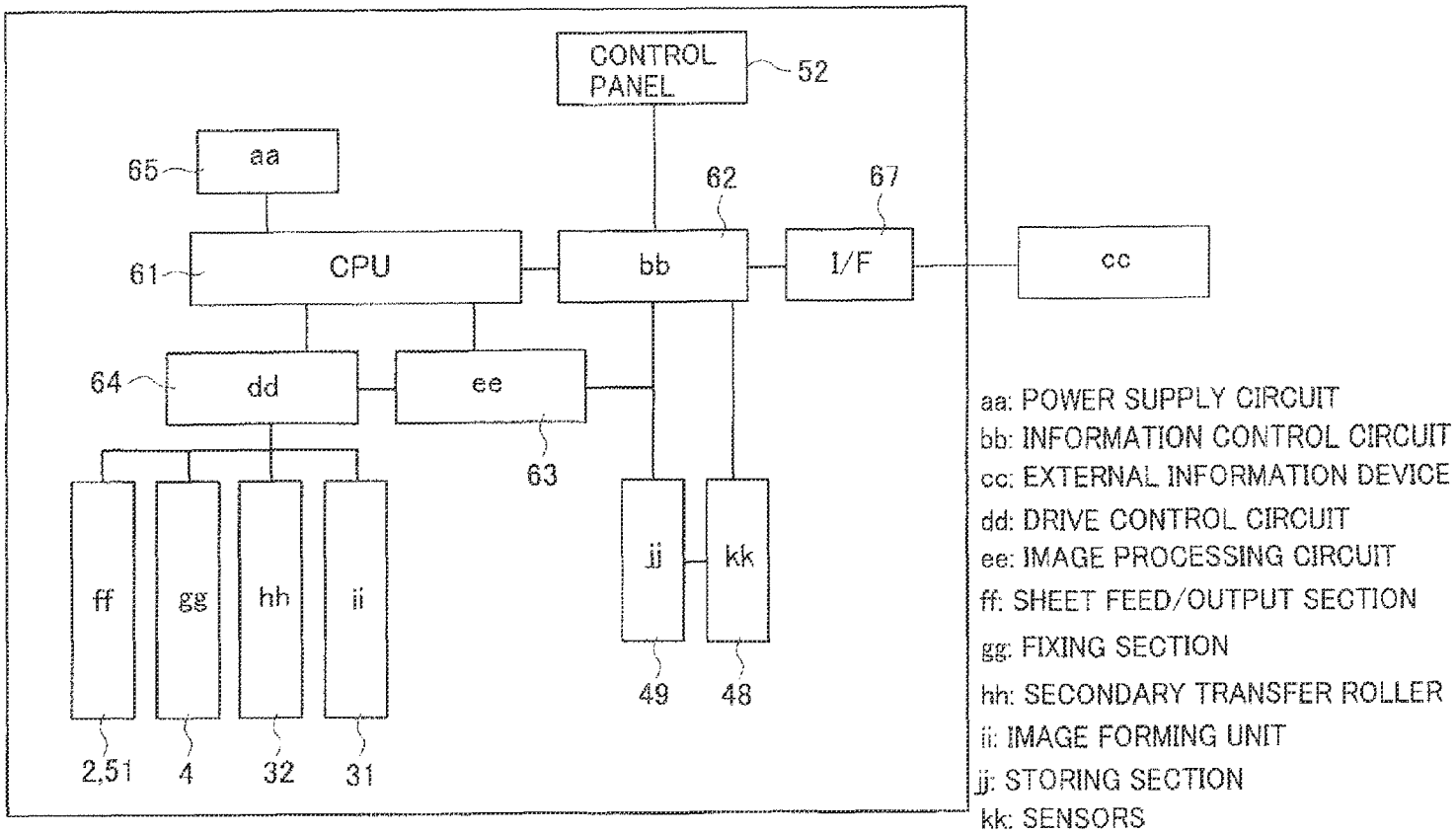
FIG. 2 is a block diagram showing a configuration of a control system of the image forming apparatus in the embodiment.

The image processing circuit 63 in FIG. 2 in the image forming apparatus 1 determines the minimum fixing temperature for each page in the following manner based on Table 1 or Table 2.

Figure 3:
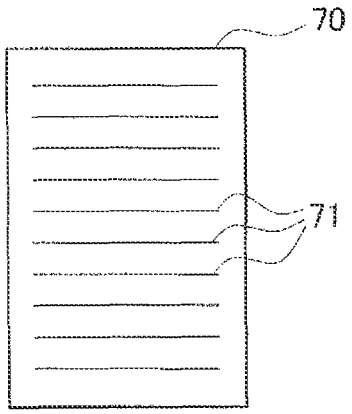
FIG. 3 is a diagram showing one example of an image (a text image) to be formed by the image forming apparatus.

Firstly, an example of a page 70 consisting of only text over an entire page is shown in FIG. 3. An image on the page 70 in FIG. 3 includes a plurality of rows as the imaging objects. Each row consists of a character string 71. The character strings are the line-drawing objects. Each character of the character strings 71 mainly consists of drawing lines. PDL data of the page 70 includes information related to species and dimensions (i.e., points) of characters forming each row and character-decoration setting (including fonts). Thus, based on this PDL data, a maximum one of line thicknesses of the lines constituting the character string 71 in each row can be extracted. Furthermore, based on a largest value among the maximum line thicknesses of the character strings 71 in rows, Table 1 is referred to. The minimum fixing temperature for the page 70 is thus determined. It is of course that Table 1 may be referred to not only per row but also per paragraph or per character.

Figure 4:
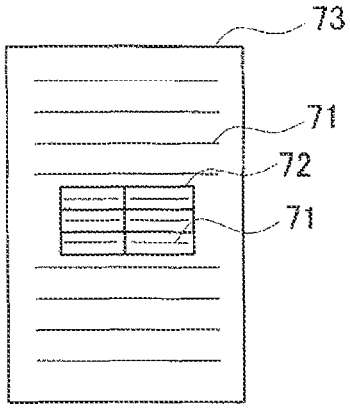
FIG. 4 is a diagram showing another example of an image (a text image including ruled lines) to be formed by the image forming apparatus.

The same applies to a page 73 consisting of text including ruled lines 72 as shown in FIG. 4. An image on the page 73 includes a table drawn with the ruled lines 72. The ruled lines 72 are also the line-drawing objects. The information on the ruled lines 72 is also included in the PDL data of the page 73. Thus, a maximum one of line thicknesses of the ruled lines 72 is extracted in addition to each character string 71 inside and outside the table. Based on a largest value among the extracted maximum line thicknesses, the minimum fixing temperature for the page 73 is determined based on Table 1. Of course, the same applies to underlines attached to the character strings 71 as well as the ruled lines 72 constituting the table.

Figure 5:
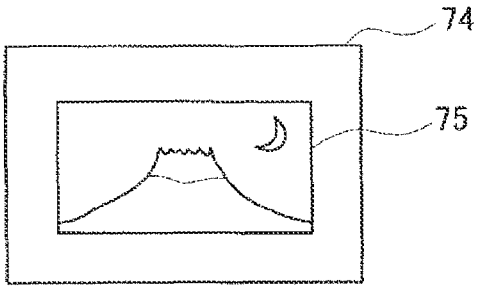
FIG. 5 is a diagram showing another example of an image (a picture image) to be formed by the image forming apparatus.

A page 74 exemplified in FIG. 5 is a page including a picture object 75 as the imaging object. The information on the picture object 75 is naturally included in the PDL data of the page 74. Therefore, the picture object 75 is subdivided into multiple subdivided regions and a largest value among densities of the subdivided regions is extracted. Based on the extracted largest density value, Table 2 is referred to. The minimum fixing temperature for the page 74 is thus determined. If a plurality of picture objects are included in one page, the minimum fixing temperature is determined based on a highest one of the maximum density values of the picture objects.

Figure 6:
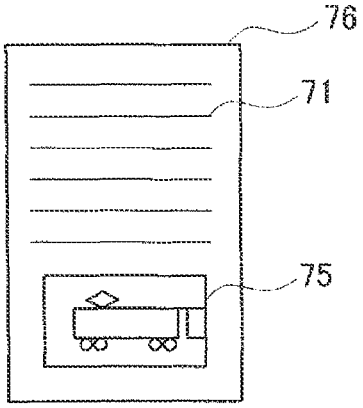
FIG. 6 is a diagram showing another example of an image (an image including both of text and picture) to be formed by the image forming apparatus.

FIG. 6 exemplifies a page 76 including both the character strings 71 and the picture object 75 as the imaging objects. For this type of page, Table 1 and Table 2 are both used. Specifically, a higher one of a fixing temperature required for the character strings 71 (Table 1) and a fixing temperature required for the picture object 75 (Table 2) is determined as the minimum fixing temperature for the page 76. The same also applies to a case of additionally including ruled lines.

Figure 7:
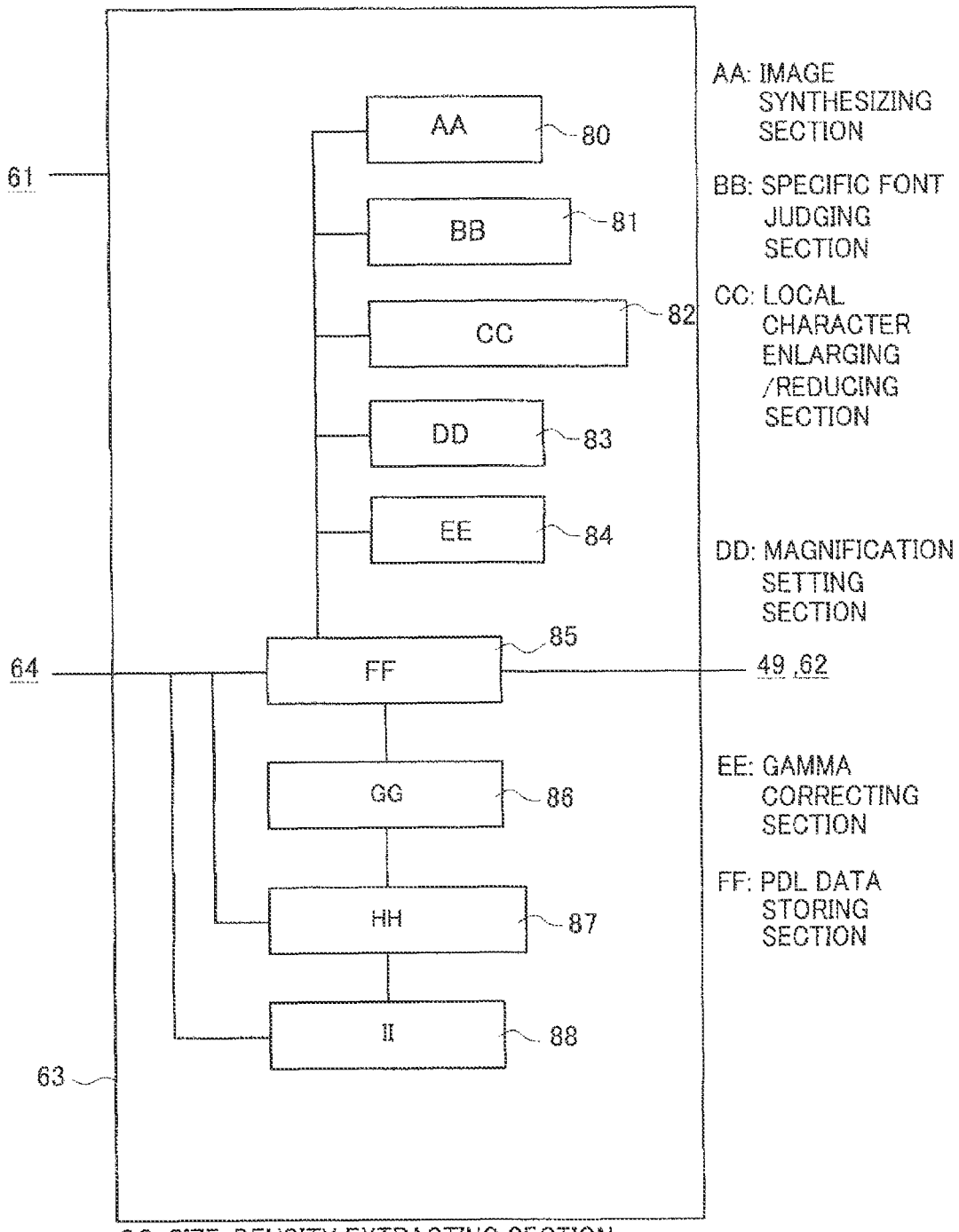
FIG. 7 is a block diagram showing a configuration example of an image processing circuit.

FIG. 7 is a configuration example of the image processing circuit 63 to determine the above minimum fixing temperature. The image processing circuit 63 is configured centering around a PDL data storage section 85. This PDL data storing section 85 is an area for storing PDL data of an image to be subjected to execution of image formation, which is supplied from the storing section 49. The PDL data storing section 85 is provided with an image synthesizing section 80 involved in image formation, a specified font judging section 81 involved in judgment of a fixing temperature determining font, a local character enlarging-reducing section 82 involved in bold setting and enlarged/reduced characters, a magnification setting section 83 involved in zoom and page layout, and a gamma correcting section 84 involved in γ correction. Besides the above, the image processing circuit 63 is further provided with a size-density extracting section 86 for extracting and judging size information and density information, a minimum fixing temperature determining section 87 for determining a minimum fixing temperature, and a toner saving mode setting section 88 involved in a toner saving mode. The details of the above sections will be explained later.

Figure 8:
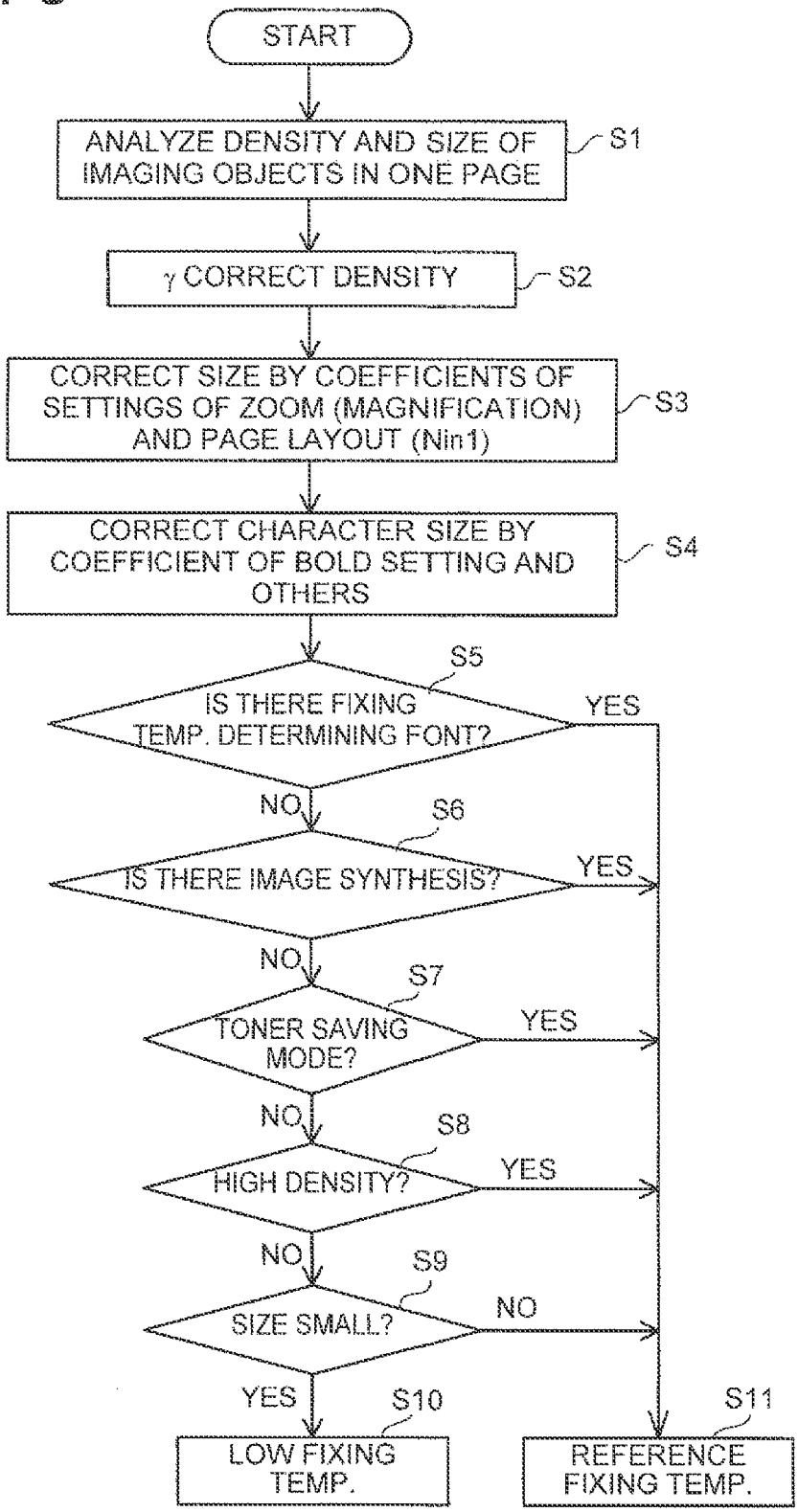
FIG. 8 is a flowchart showing a sequence of steps of determining a minimum fixing temperature.

A sequence of steps of determining the minimum fixing temperature based on the PDL data will be explained below referring to a flowchart (FIG. 8). In this flowchart, various conditions are taken into account as well as the size and the density explained above. These are explained below in order.

Image data of a target page is firstly analyzed. Accordingly, the size and the density of each imaging object in the relevant page are extracted (S1). This analysis is performed based on the PDL data of the target page. This processing is executed by the aforementioned size-density extracting section 86. The information obtained at this stage is the size of a line-drawing object and the density of a picture object. Even the line-drawing object may have the density if it is set thereof. Further, even the picture object may include line-drawing figures, halftone dot regions, and others and thus have the size. These informations are used to determine the minimum fixing temperature at subsequent steps.

Successively, of the size and density of each imaging object obtained by analysis in S1, the density is subjected to well-known γ(gamma) correction (S2). This processing is performed by the aforementioned gamma correcting section 84. The γ correction is well-known correction to cancel the density characteristics in image formation to be performed in the image forming section 3 and obtain an output image density in accordance with input data. The γ correction is performed on all imaging objects having the density information, included in the target page. In particular, the picture object surely has the density information and thus is inevitably subjected to the γ correction.

Figure 9:
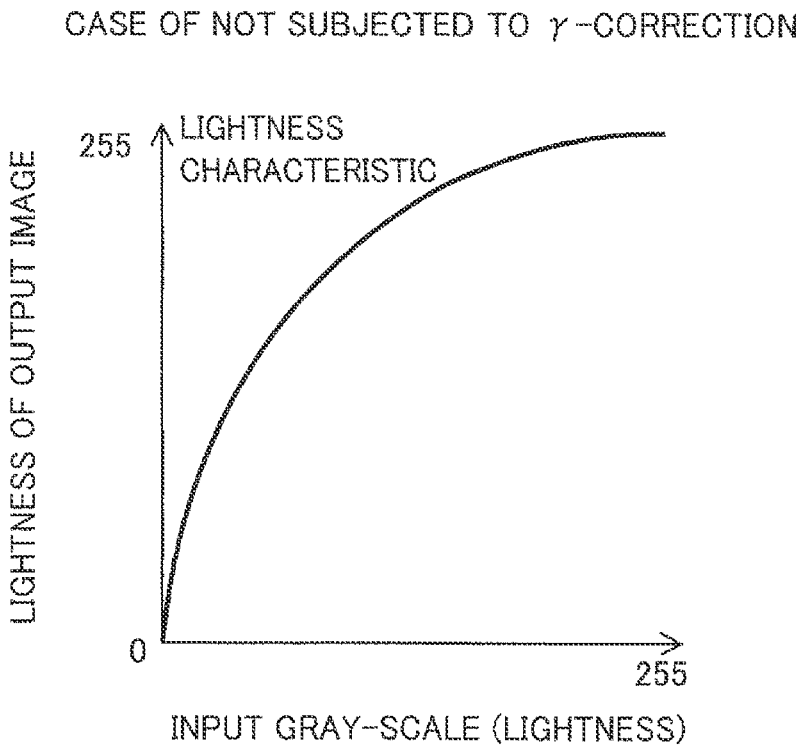
FIG. 9 is a graph showing lightness characteristics in image formation in an image forming section.
Figure 10:
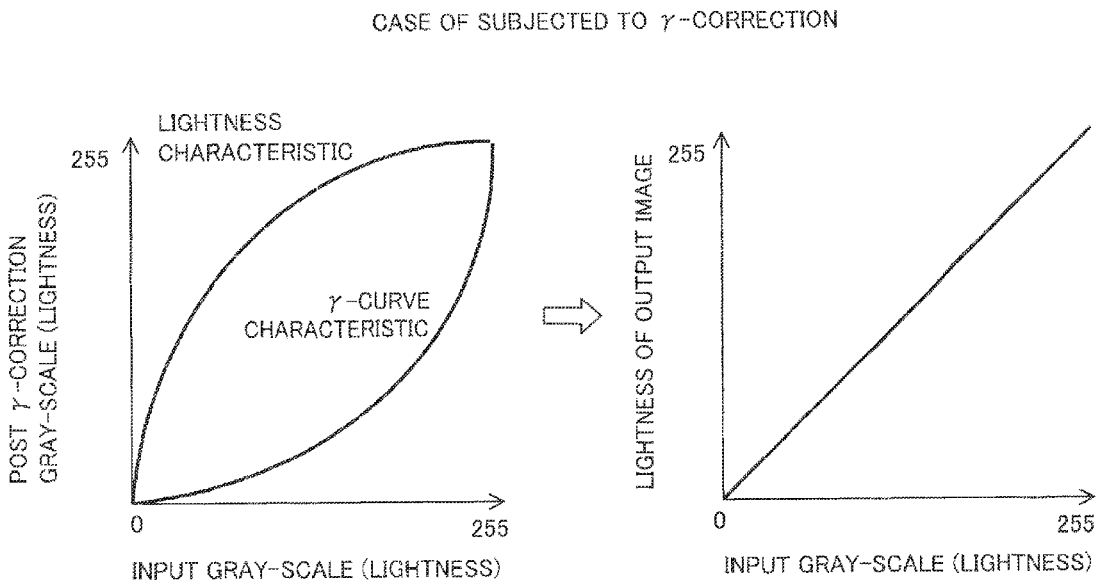
FIG. 10 is a graph to explain γ correction in image formation.

The γ correction is briefly explained. In a case of not performing the γ correction, target image formation in the image forming section 3 results in the lightness characteristics as shown in a graph of FIG. 9 that the lightness of an output image is plotted in an upward protruding curve without being linear with respect to the gray-scale (lightness) of input data. Specifically, an obtained output image has excessive lightness with respect to the input data in a halftone region, as compared with a low gray-scale region or a high gray-scale region. Therefore, as shown in a left graph in FIG. 10, the input gray-scale (lightness) is subjected to correction using an inverse characteristic (a γ-curve characteristic) to the graph of FIG. 9. This is the γ correction. In the graph of FIG. 10, the same curve as the curve of FIG. 9 is plotted with a broken line.

Actual image formation is performed based on a gray-scale value after the γ correction. Accordingly, as shown in a right graph of FIG. 10, the original lightness characteristic is canceled out and thus an output image with linear lightness with respect to the input gray-scale is obtained. The aforementioned γ correction is generally performed in image formation using toner. The image forming apparatus 1 of the present embodiment is also arranged to perform the γ correction at the time of executing image formation. As described in a later step, the density to be used to determine the minimum fixing temperature is also a value after the γ correction. Although FIGS. 9 and 10 are explained using the lightness, the same applies to the density. The density and the lightness are complementary concepts.

Further, of the size and density of each drawing object obtained in the analysis in S1, the size is also subjected to correction (S3, S4).

In S3, size correction applicable to all imaging object or each drawing object having size information included in a page targeted for printing, is performed. This processing is conducted in the aforementioned magnification setting section 83. Specifically, at the time of executing image formation based on a print job, in some cases, a page magnifying function has been set, which may affect the dimension of an imaging object. Examples thereof are zoom printing, multiple-page layout printing, and others. In the zoom printing, printing is performed by entirely enlarging or reducing the size of an original image. Therefore, the size of each imaging object included therein is also naturally enlarged or reduced. Correcting this corresponds to the correction in S3. The same applies to the multiple-page layout printing (2 in 1, 4 in 1, etc.) in which an image of each page is reduced in size.

In the correction in S3, size of each imaging object particularly line-drawing object included in a target page corrected by multiplying the size by an enlarging or reducing magnification rate. This special function which will be a factor for correction in S3 may be set in PDL data or may be temporarily set, separately from the PDL data, by a command input on the control panel 52 by a user.

In S4, size correction applicable to only a specified one(s) of the line-drawing objects included in the target page is performed. This processing is conducted in the aforementioned local character enlarging-reducing section 82. Specifically, of the text included in the printing target page, only a specified character or character string is subjected to bold setting or magnifying character setting such as enlarged character (double size, quadruple size, etc.) and reduced character (superior, inferior, etc.). The sizes of those characters subjected to the setting are naturally different from the sizes of the characters not subjected to the setting. Correcting based on this difference corresponds to the correction in S4. In S4, the correction is made by analyzing image data to identify the presence/absence and the type of the above modifying character setting in each line-drawing object included in a target page. Of the line-drawing objects, the line-drawing object(s) having been subjected to any of the aforementioned settings is corrected in size. To be concrete, the correction is performed by multiplying the target object by a coefficient according to the type of the setting.

The aforementioned processings in S1 to S4 are to be performed as a part to execute image formation in the image forming section 3. The obtained information is used in the following processing in S5 and subsequent processings to determine the minimum fixing temperature.

Font information assigned to the text in the target page is first checked (S5). This processing is performed by the aforementioned specified font judging section 81. Specifically, it is checked whether or not a character or characters set in a fixing temperature determining font are present. The fixing temperature determining font is one(s) of various fonts and designated as a font on which fixing at a reference fixing temperature is determined. A font(s) designated as the fixing temperature determining font is stored in the storing section 49. In general, an unsupported unknown font(s) (a new font(s) and others) is universally designated as the fixing temperature determining font. A known font(s) also may be designated as the fixing temperature determining font as long as it is a special font having characters consisting of extra-thick lines.

When the characters of a text included in a target page include a character(s) set in the fixing temperature determining font (S5: Yes), the reference fixing temperature is determined as the minimum fixing temperature for the target page (S11) without performing the processing in S6 and subsequent steps. This is because a low fixing temperature may be insufficient to approximately fix the characters set in the fixing temperature determining font. When any character set in the fixing temperature determining font is not present (S5: No), the processing advances to S6.

Subsequently, it is checked whether or not image synthesis is set in the target page (S6). This processing is performed in the aforementioned image synthesizing section 80. The image synthesis in this specification represents adding another image to an original image of the target page when image formation is executed in the image forming section 3. Examples of the image synthesis are adding a watermark, overlay, and adding a copy security mark.

The watermark is an electronic watermarking image unrecognizable with naked eyes, which is added to track a copying history of an image. The overlay is to overlay images of two or more pages one on another by OR calculation to form one page. The copy security mark is a mark to be added to call attention of a person who gets or sees a document to the fact that the document includes confidential information.

When the above functions are ON, an imaging object different from each imaging object for the original image of the target page is generated. Thus, a figure having a larger size than the size of each drawing object for the original image will be formed. This needs a high fixing temperature.

Accordingly, when the image synthesis is set for the target page (S6: Yes), the reference fixing temperature is determined as the minimum fixing temperature for the target page (S11) without performing the processing in S7 and subsequent steps. When the image synthesis is not set (S6: No), the processing advances to S7. Since the setting of image synthesis is taken into account as above, the fixing temperature can be determined more appropriately in response to a toner amount of an image to be actually formed. The types of image synthesis to be determined in S6 may also include adding a header and/or a footer in addition to the above.

Successively, it is checked whether or not a toner saving mode is set for printing of the target page (S7). This processing is performed by the aforementioned toner saving mode setting section 88. The toner saving mode is a mode of performing image formation with a smaller amount of toner than in a normal mode under adjusted development conditions and others. The smaller amount of toner enables image formation at a lower fixing temperature than the image formation using a normal toner amount.

In the example shown in FIG. 8, fixing at a lower fixing temperature than the reference fixing temperature is allowed only when the toner saving mode is set, while fixing at the reference fixing temperature is designated in a normal mode. If the toner saving mode is not set, that is, in the normal mode (S7: No), the reference fixing temperature is determined as the minimum fixing temperature for the target page (S11) without performing the processings in S8 and subsequent step. If the toner saving mode is set (S7: Yes), the processing advances to S8. Since the setting situation of the toner saving mode is taken into account, the fixing temperature can be determined more appropriately in response to a toner amount of an image to be actually formed.

Subsequently, the density information of each imaging object in the target page is checked (S8). This processing is performed by the aforementioned minimum fixing temperature determining section 87. Specifically, the density information analyzed in S1 and subjected to the γ correction in S2 is checked. Using the density information having been subjected to the γ correction makes it possible to determine a fixing temperature with higher fidelity in response to a toner amount of an image to be actually formed.

A judgment target in this step is an imaging object having a highest density among the density information of the imaging objects in the target page. If a highest density value is a predetermined value (192/255 in Table 2) or more (S8: Yes), the reference fixing temperature is determined as the minimum fixing temperature for the target page (S11) without performing the processing in S9. This is because the target page includes a picture object having a high density value and thus a low fixing temperature is insufficient. If the highest density value is less than the predetermined value (S8: No), the processing advances to S9.

The size information of each imaging object in the target page is checked (S9). This processing is also performed by the aforementioned minimum fixing temperature determining section 87. Specifically, the size information analyzed in S1 and subjected to the size correction in S3 and S4 is checked. Using the size information having been subjected to the size correction makes it possible to determine a fixing temperature with higher fidelity in response to a toner amount of an image to be actually formed.

A judgment target in this step is an imaging object having largest size information among the size information of the imaging objects in the target page. If a largest size exceeds a predetermined value (0.8 mm in Table 1) (S9: No), the reference fixing temperature is determined as the minimum fixing temperature for the target page (S11). This is because the target page includes an imaging object having a thick drawing line and thus needs fixing at a high fixing temperature. On the other hand, if the largest size is the predetermined value or less (S9: Yes), a lower fixing temperature than the reference fixing temperature is determined as the minimum fixing temperature for the target page (S10). This is because there is no necessity to use a high fixing temperature in view of every condition in S5 to S9.

Regarding this case in S10, the aforementioned paragraphs simply show the low fixing temperature. However, in Tables 1 and 2, the low fixing temperature is classified into three levels. Actually, a required highest one among the three levels of fixing temperatures is determined as the minimum fixing temperature. In other word, any one of the three levels of temperatures; "Very Low", "Low", and "Slightly Low" is selected according to Table 2 based on the highest density information at the stage of S8:No and according to Table 1 based on the largest size information at the stage of S9:Yes.

In S10, when the level selected at the stage of S8:No and the level selected at the stage of S9:Yes are the same, the temperature at the same selected level is determined as the minimum fixing temperature for the target page. When the selected levels are not the same, a higher one of the two selected temperatures is determined as the minimum fixing temperature for the target page. In the above manner, the minimum fixing temperature is determined for each page. A command indicative of the determined minimum fixing temperature is given to the fixing section 4 via the drive control circuit 64. The temperature setting of the fixing section 4 follows the command. The above manner is intended to achieve energy saving in the fixing section 4 without causing fixing failures of a formed image.

In S8 and S9, if Tables 1 and 2 provide only two levels of fixing temperatures, a lower fixing temperature than the reference fixing temperature is selectable only if the size information of all the imaging objects is a threshold value or less. Similarly, a lower fixing temperature than the reference fixing temperature is selectable only if the density information of all the imaging objects is a threshold value or less. In other words, the lower fixing temperature than the reference fixing temperature is selectable only when a largest one of size information of the imaging objects is the threshold value or less. Similarly, the lower fixing temperature than the reference fixing temperature is selectable only when a highest one of density information of the imaging objects is the threshold value or less. That is to say, the reference fixing temperature is selected as long as the imaging objects include at least one having the size information exceeding the threshold. Similarly, the reference fixing temperature is selected as long as the imaging objects include at least one having the density information exceeding the threshold.

The above explanation is related to the flowchart in FIG. 8. Determining the minimum fixing temperature in the processings in FIG. 8 may be variously modified. The processings in S5 to S9 in FIG. 8 contribute to determining the minimum fixing temperature. Of these processings, modified examples of S6 and S7 will be explained below.

A modified example of the processing in S6 is first explained. The aforementioned explanation about S6 is made under the condition that the reference fixing temperature is uniformly determined as the minimum fixing temperature when the image synthesis is set for the target page. However, not limited thereto, the density information and the size information may be considered even when the image synthesis is set. In this case, the following processing is performed. Specifically, the minimum fixing temperature is set higher than the minimum fixing temperature determined in S10 as assuming that no image synthesis is set, that is, the minimum fixing temperature determined based on the density value or the size value. To be more specific, a fixing temperature shifted from the minimum fixing temperature determined in S10 to a higher side by one level or two levels in the aforementioned four levels of fixing temperatures is determined as the minimum fixing temperature for the target page.

For instance, it is assumed that the "minimum fixing temperature determined in S10 as assuming that the image synthesis is not set" is "Very Low" among the aforementioned four levels. In this case, since the image synthesis setting is ON, the "Low" or "Slightly Low" minimum fixing temperature is determined. In a case where the "minimum fixing temperature itself determined in S10 as assuming that the image synthesis is not set" is "High", even when the image synthesis setting is ON, the "High", i.e., reference fixing temperature is selected. Because there is no higher fixing temperature than that temperature. Briefly, the minimum fixing temperature in the presence of the image synthesis setting has only to be a temperature equal to or higher than the minimum fixing temperature in the absence of the image synthesis setting. However, the temperature exceeding the reference fixing temperature is not selected. Furthermore, when the image synthesis is set, the degree of rising the minimum fixing temperature in the presence of the image synthesis setting from that in the absence of the image synthesis setting may be different according to the type of the set image synthesis.

A modified example of the processing in S7 is explained below. The modified example of S7 is also made based on almost the same concept as the modified example of S6. Specifically, the aforementioned explanation of the processing in S7 is modified so that, even in the case of the normal mode, not the toner saving mode, the reference fixing temperature is not uniformly selected. In this modified example, in the normal mode, similar to the explanation of the modified example of S6, the fixing temperature shifted to a higher side with respect to the minimum fixing temperature determined in S10 is determined as the minimum fixing temperature for the target page. It is essential only that the minimum fixing temperature in the presence of the toner saving mode setting is set to be equal to or less than the minimum fixing temperature in the absence of the toner saving mode setting. However, a temperature further lower than the lowest fixing temperature designated in Tables 1 and 2 is not selected.

It may also be arranged to additionally consider other conditions than the above conditions taken into account in the steps S5 to S9 in FIG. 8. The other conditions may include the following conditions, which will be briefly explained below.

Type of recording medium: Cardboard

Color mode

Environmental factors

Second surface for double-side printing

In the case where a cardboard sheet is used as the recording medium, it is necessary to increase a heat generating amount of the fixing section 4 as compared with the case where a normal print sheet is used. This is because the cardboard sheet removes a large amount of heat from the fixing section 4. In the case of using the cardboard, accordingly, it is necessary to set a higher fixing temperature as compared with the case of using a normal print sheet. For the cardboard, the reference fixing temperature may also be uniformly used.

Depending on the species of toner, the fixing characteristics may be different from color to color. In this case, it is more preferable to provide Tables 1 and 2 for each color.

Depending on the environmental conditions, the amount of heat removed from the fixing section 4 by the recording medium may be large in some cases; e.g., the case with low ambient temperature and/or the case with high humidity. When the environmental conditions correspond to those cases, the fixing temperature has to be set to be higher than that in the other case. When the environmental conditions are to be taken into account, the sensors 48 shown in FIG. 2 need to include an environmental factor sensor. The above control is performed under the condition that a threshold is set to at least one of temperature and humidity.

For the second surface in the double-side printing, while the temperature of a recording medium is originally high to a certain degree, secondary transfer is performed and fixing is conducted. Accordingly, the amount of heat to be removed from the fixing section 4 by the recording medium is small. For the second surface in the double-side printing, the fixing temperature can be set to be lower than that in the other case (one-side printing, a first surface in double-side printing).

The minimum fixing temperature is determined in the above manner for each page included in a print job which is a target for image formation. As a result, when the minimum fixing temperatures are coincident to each other for all the pages included in the target print job, naturally, the temperature of the fixing section 4 is set to the coincident minimum fixing temperature. In that state, image formation of the target print job is executed from start to end. When the coincident minimum fixing temperature is a lower temperature than the reference fixing temperature, the energy saving in the fixing section 4 is achieved.

When the minimum fixing temperature different from page to page is determined, the temperature setting of the fixing section 4 is changed even in the course of a job. For example, in a print job of two pages, it is assumed that the minimum fixing temperature turns down in the course of the job.

$1^{st}$ page: "High"→$2^{nd}$ page: "Slightly Low"

In this case, naturally, the image formation on the first page is performed at the reference fixing temperature (High). After the image formation on the first page is completed, the temperature setting of the fixing section 4 is changed from the reference fixing temperature (High) to a temperature (Slightly Low) lower than the reference fixing temperature by 5° C. In this state, image formation on the second page is started. In this case, during execution of the image formation on the second page, an actual temperature of the fixing section 4 may not fully drop to the "Slightly Low" temperature. However, this causes no problem and the image formation on the second page can be started immediately. Even this configuration can save energy to a certain extent.

On the other hand, in a print job of two pages, it is assumed that the minimum fixing temperature rises as below in the course of the job.

$1^{st}$ page: "Slightly Low"→$2^{nd}$ page: "High"

In this case, the image formation on the first page is performed at the "Slightly Low" fixing temperature. After completion of the image formation on the first page, when the temperature setting of the fixing section 4 is changed from the "Slightly Low" temperature to the reference fixing temperature (High), the image formation on the second page has to wait for a while to start because the actual temperature of the fixing section 4 does not immediately rise. Therefore, in the case where the minimum fixing temperature rises in the course of the job, it is preferable to switch the temperature setting of the fixing section 4 slightly in advance by taking into consideration the time needed for temperature rise in the fixing section 4. This enables image formation having no waiting time. This configuration can achieve energy saving to a certain degree. The degree of advancement of the switching of the temperature setting may be determined in advance in the storing section 49 according to the width of halfway rise of the minimum fixing temperature.

Further, in a print job of three pages or more, it is assumed that the minimum fixing temperature drops once in the course of the job and then rises again as below.

Initial-stage page(s): "High"→Middle-stage page(s): "Slightly Low"→Last-stage page(s): "High"

In this case, from the above explanation, switching of turning down the temperature setting of the fixing section 4 has only to be performed according to the progress of image formation. Subsequent rising switching is preferably slightly advanced than the progress of image formation. This configuration can provide the energy saving effect to a certain degree.

In this case, if the number of pages corresponding to the "Slightly Low" at the middle stage is very small, the halfway switching of the temperature setting of the fixing section 4 may be skipped to keep the setting at "High". Regarding the number of pages corresponding to the above "Middle-stage", a minimum value thereof at which the dropping switching is performed in the course of the temperature setting is preferably determined in advance in the storing section 49.

On the other hand, a reverse situation that the minimum fixing temperature halfway rises once and thereafter drops again is assumed.

Initial-stage page(s): "Slightly Low"→Middle-stage page(s): "High"→Last-stage page(s): "Slightly Low"

In this case, different from the above, even when the number of pages corresponding to the "Middle-stage" is only one, halfway rising switching of the temperature setting must be executed. Otherwise, fixing failure may be caused in a page corresponding to the "Middle-stage".

According to the present embodiment explained above in detail, according to the contents of an image to be formed, the lower fixing temperature than the reference fixing temperature of toner to be used may be used in some cases. To be concrete, the minimum fixing temperature is determined for each imaging object in the printing target page based on the size information or the density information. The highest temperature of the minimum fixing temperatures of the imaging objects in the page is determined as the minimum fixing temperature for the target page. Accordingly, the fixing temperature as low as possible within a range that causes no fixing failure is used to reduce the energy to be consumed in the fixing section 4.

The present embodiment, the image forming apparatus preferably includes a density judging section configured to judge whether or not the highest one of the density values of the drawing objects in the page image targeted for image formation is lower than a predetermined reference density value. When the density judging section judges that the highest value is lower than the reference density value, the temperature determining section determines the minimum fixing temperature for the recording medium with the page image to a low fixing temperature lower than a predetermined standard fixing temperature. When the minimum fixing temperature is not determined to the low fixing temperature, the minimum fixing temperature is determined to the standard fixing temperature. Accordingly, the fixing temperature control based on the density values of the imaging objects is performed.

The density judging section may be configured to judge whether or not the density value of each of the drawing objects in the page image targeted for image formation is lower than the predetermined reference density value. In this case, when the density judging section judges that the density values of all the drawing objects in the page image are lower than the reference density value, the temperature determining section determines the minimum fixing temperature for the recording medium with the page image to the low fixing temperature.

As an alternative, the image forming apparatus configured as above may include a size judging section configured to judge whether or not the largest one of the size values of the drawing objects in the page image targeted for image formation is smaller than a predetermined reference size value. When the size judging section judges that the largest value is smaller than the predetermined size value, the temperature determining section determines the minimum fixing temperature for the recording medium with the page image to a low fixing temperature lower than the predetermined standard fixing temperature. When the minimum fixing temperature is not determined to the low fixing temperature, the minimum fixing temperature is set to the standard fixing temperature. Thus, the fixing temperature control based on the size values of the drawing objects is performed. Further, both the density judging section and the size judging section may also be provided.

The size judging section may also be configured to judge whether or not the size value of each of the drawing objects in the page image targeted for image formation is smaller than a predetermined reference size value. When the size judging section judges that the size values of all the drawing objects in the page image are smaller than the reference size value, the temperature determining section determines the minimum fixing temperature for the recording medium with the page image to a low fixing temperature.

An image analyzing section of the image forming apparatus configured as above is preferably arranged to extract line thickness values of a character or a line-drawing image as the size values of the drawing objects. This is because the line thicknesses of characters and line-drawing images are parameters closely related to the possibility of causing fixing failures. Specifically, an imaging object having thin line thickness can be fixed at a lower fixing temperature. On the other hand, an imaging object having thick line thickness may cause fixing failures unless it is fixed at a higher fixing temperature close to the original reference fixing temperature of toner to be used.

Preferably, the image forming apparatus configured as above includes a gamma correcting section configured to apply gamma correction to the density value of the drawing objects extracted by the image analyzing section, and the image forming section is arranged to form the toner image based on image data after the gamma correction ("post gamma correction image data"). In this case, the temperature determining section determines the minimum fixing temperature for the recording medium with the page image by use of a density value after the gamma correction ("post gamma correction density value"). The gamma correction itself is to be performed for good reproduction of a halftone image. Since the post gamma correction density value is also used in the fixing temperature control using the density value, the fixing temperature control is performed according to an amount of toner to be actually transferred to the recording medium.

Moreover, the image forming apparatus configured as above may include a page setting section configured to perform zoom setting or multiple-page layout setting for image formation to be performed in the image forming section. In this case, when the page setting section turns on the zoom setting or the multiple-page layout setting, the temperature determining section corrects the size value of each of the drawing objects in the page image targeted for image formation based on contents set by the page setting section and determines the minimum fixing temperature for the recording medium with the page image. When the image formation is performed while the page magnification (zoom or multiple-page layout) is set, the size value of each imaging object in a toner image to be actually transferred onto the recording medium is also influenced by the page magnification. Accordingly, the above correction is performed to execute the fixing temperature control according to the size value in the toner image to be actually transferred to the recording medium.

Still preferably, the image forming apparatus configured as above includes a magnification analyzing section configured to analyze contents of magnified character setting which may be set to a text of the image targeted for image formation. When a drawing object including the text to which the magnified character setting is turned ON is present in the page image targeted for image formation, the temperature determining section corrects the size value of the drawing object including the text targeted for the magnified character setting, among the drawing objects in the page image targeted for image formation, based on the contents of the magnified character setting and determines the minimum fixing temperature for the recording medium with the page image. In the case of the text set in magnified character (bold, double size, quadruple size, superior, inferior, etc.), the size value of each imaging object in the toner image to be actually transferred to the recording medium is also influenced by the magnified character setting. Accordingly, the above correction is performed to execute the fixing temperature control according to the size value in the toner image to be actually transferred to the recording medium.

Preferably, the image forming apparatus configured as above includes a font analyzing section configured to analyze contents of font setting when this setting may be set to a text of an image targeted for image formation, and a specified font designating section configured to designate a specified font requiring fixing at the standard fixing temperature from among part of fonts settable to the text. When a drawing object including the text to which a font corresponding to the specified font is set is present in the page image targeted for image formation, the temperature determining section determines the minimum fixing temperature for the recording medium with the page image to the standard fixing temperature irrespective of the size value of each of the drawing objects or the size values and the density values. For instance, it is conceivable that an unsupported, unknown font in the relevant image forming apparatus is recognized as the specified font. This configuration can prevent fixing failures caused by formation of an image with a large size contrary to expectations.

In the image forming apparatus configured as above, the image analyzing section may use a type of page-description language or intermediate language as the image data of the image to be formed in the image forming section.

The image forming apparatus configured as above may include an image setting section configured to set image synthesis in the image formation to be performed in the image forming section. When the image setting section sets the image synthesis for the page image targeted for image formation, the temperature determining section determines the minimum fixing temperature for the recording medium with the page image to a temperature equal to or higher than the minimum fixing temperature determined based on the density value or the size value. The reason is because when the image synthesis is set, an image having a size value equal to or larger than the size value analyzed from the image data may appear on the recording medium.

The image forming apparatus configured as above may also include a saving setting section configured to set that formation of a toner image in the image forming section is performed in a toner saving mode. When the toner saving mode is set, the temperature determining section determines the minimum fixing temperature for the recording medium with the page image to a temperature equal to or lower than the minimum fixing temperature determined based on the density value or the size value. When the toner saving mode is set, naturally, an amount of toner to be actually transferred to the recording medium is smaller than that in the case where the toner saving mode is not set.

According to the image forming apparatus configured as above, it is possible to set a target fixing temperature adequately reflecting the contents of an image to be formed, thereby appropriately forming an image while optimizing input energy to the fixing section.

The above embodiment is a mere example and thus does not limit the present invention. Thus the present invention may be embodied in other specific forms without departing from the essential characteristics thereof. For instance, the present invention is also applicable not only to the image forming apparatus functioning as a printer shown in FIG. 1 but also an apparatus provided with a scanner section and configured to obtain image data from a document or configured to transmit and receive image data with respect to an external device through a public line. Further, the present invention is not limited to a color device. Any toner may be used irrespective of a single component type or a two-component type.

REFERENCE SIGNS LIST

1 Image forming apparatus
3 Image forming section
4 Fixing section
49 Storing section
80 Image synthesizing section (Image setting section)
81 Specific font judging section (Font analyzing section)
82 Local character enlarging-reducing section (Magnification analyzing section)
83 Magnification setting section (Page setting section)
84 Gamma correcting section
86 Size-density extracting section (Image analyzing section, Density judging section, Size judging section)
87 Minimum fixing temperature determining section
88 Toner saving mode setting section (Saving setting section)

What is claimed is:

1. An image forming apparatus including:

an image forming section configured to form a toner image based on image data and transfer the formed toner image to a recording medium;

a fixing section configured to heat the recording medium to which the toner image has been transferred in the image forming section to fix the toner image;

an image analyzing section configured to extract, from the image data of the image to be formed in the image forming section, at least one of a density value and a size value of each of imaging objects included in the image;

a temperature determining section configured to determine a minimum fixing temperature of the fixing section for the recording medium transferred with a page image which is an image corresponding to one page of the recording medium to be formed in the image forming section, the minimum fixing temperature being determined based on the extracted density values or size values of the imaging objects included in the page image, the temperature determining section is configured to perform, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger; and a gamma correcting processing section configured to apply gamma correction to the density values of the imaging objects extracted by the image analyzing section, wherein the image forming section is configured to form the toner image based on post gamma correction image data, and the temperature determining section is configured to determine the minimum fixing temperature for the recording medium with the page image by use of a post gamma correction density value.

2. The image forming apparatus according to claim 1, further including a density judging section configured to judge whether or not the highest one of the density values of the imaging objects in the page image targeted for image formation is lower than a predetermined reference density value, wherein the temperature determining section is configured to:

determine the minimum fixing temperature for the recording medium with the page image to a low fixing temperature lower than a predetermined reference fixing temperature when the density judging section judges that the highest value is lower; or determine the minimum fixing temperature to the reference fixing temperature when the minimum fixing temperature is not determined to the low fixing temperature.

3. The image forming apparatus according to claim 1, further including a density judging section configured to judge whether or not the density value of each of the imaging objects in the page image targeted for image formation is lower than a predetermined reference density value, wherein the temperature determining section is configured to:

determine the minimum fixing temperature for recording medium with the page image to a low fixing temperature lower than a predetermined reference fixing temperature when the density judging section judges that the density values of all the imaging objects in the page image are lower; or determine the minimum fixing temperature to the reference fixing temperature when the minimum fixing temperature is not determined to the low fixing temperature.

4. The image forming apparatus according to claim 1, further including a size judging section configured to judge whether or not the largest one of the size values of the imaging objects in the page image targeted for image formation is smaller than a predetermined reference size value, wherein the temperature determining section is configured to:

determine the minimum fixing temperature for the recording medium with the page image to a low fixing temperature lower than a predetermined reference fixing temperature when the size judging section judges that the largest value is smaller; or determine the minimum fixing temperature to the reference fixing temperature when the minimum fixing temperature is not determined to the low fixing temperature.

5. The image forming apparatus according to claim 1, further including a size judging section configured to judge whether or not the size value of each of the imaging objects in the page image targeted for image formation is smaller than a predetermined reference size value, wherein the temperature determining section is configured to:

determine the minimum fixing temperature for the recording medium with the page image to a low fixing temperature lower than a predetermined reference fixing temperature when the size judging section judges that the size values of all the imaging objects are smaller; or determine the minimum fixing temperature to the reference fixing temperature when the minimum fixing temperature is not determined to the low fixing temperature.

6. The image forming apparatus according to claim 1, wherein the image analyzing section is configured to extract line thickness values of a character and a line-drawing image as the size values of the imaging objects.

7. The image forming apparatus according to claim 1, further including a page setting section configured to perform zoom setting or multiple-page layout setting for image formation to be performed in the image forming section, wherein when the zoom setting or the multiple-page layout setting is set on by the page setting section, the temperature determining section corrects the size value of each of the imaging objects in the page image targeted for image formation based on contents set by the page setting section and determines the minimum fixing temperature for the recording medium with the page image.

8. The image forming apparatus according to claim 1, further including a magnification analyzing section configured to analyze contents of magnified character setting settable to a text of the image targeted for image formation, wherein when a drawing object including the text to which the magnified character setting is on is present in the page image targeted for image formation, the temperature determining section corrects the size value of the imaging object including the text targeted for the magnified character setting, among the imaging objects in the page image targeted for image formation, based on the contents of the magnified character setting and determines the minimum fixing temperature for the recording medium with the page image.

9. The image forming apparatus including:

an image forming section configured to form a toner image based on image data and transfer the formed toner image to a recording medium;

a fixing section configured to heat the recording medium to which the toner image has been transferred in the image forming section to fix the toner image;

an image analyzing section configured to extract, from the image data of the image to be formed in the image forming section, at least one of a density value and a size value of each of imaging objects included in the image;

a temperature determining section configured to determine a minimum fixing temperature of the fixing section for the recording medium transferred with a page image which is an image corresponding to one page of the recording medium to be formed in the image forming section, the minimum fixing temperature being determined based on the extracted density values or size values of the imaging objects included in the page image, the temperature determining section is configured to perform, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger;

a size judging section configured to judge whether or not the largest one of the size values of the imaging objects in the page image targeted for image formation is smaller than a predetermined reference size value, wherein the temperature determining section is configured to:

determine the minimum fixing temperature for the recording medium with the page image to a low fixing temperature lower than a predetermined reference fixing temperature when the size judging section judges that the largest value is smaller; or determine the minimum fixing temperature to the reference fixing temperature when the minimum fixing temperature is not determined to the low fixing temperature; and a font analyzing section configured to analyze contents of font setting settable to a text of an image targeted for image formation; and a specified font designating section configured to designate part of font as a specified font requiring fixing at the reference fixing temperature from among fonts settable to the text, wherein when an imaging object including the text to which a font corresponding to the specified font is set is present in the page image targeted for image formation, the temperature determining section determines the minimum fixing temperature for the recording medium with the page image to the reference fixing temperature irrespective of the size value of each of the drawing objects or the size values and the density values.

10. The image forming apparatus according to claim 1, wherein the image analyzing section uses a type of page-description language or intermediate language as the image data of the image to be formed in the image forming section.

11. The image forming apparatus according to claim 1, further including an image setting section configured to set image synthesis in image formation to be performed in the image forming section, wherein when the image setting section sets the image synthesis for the page image targeted for image formation, the temperature determining section determines the minimum fixing temperature for the recording medium with the page image to a temperature equal to or higher than the minimum fixing temperature determined based on the density value or the size value.

12. The image forming apparatus according to claim 1, further including a saving setting section configured to set that formation of a toner image in the image forming section is performed in a toner saving mode, wherein when the toner saving mode is set, the temperature determining section determines the minimum fixing temperature for the recording medium with the page image to a temperature equal to or lower than the minimum fixing temperature determined based on the density value or the size value.

13. The image forming apparatus according to claim 2, further including a size judging section configured to judge whether or not the largest one of the size values of the imaging objects in the page image targeted for image formation is smaller than a predetermined reference size value, wherein the temperature determining section is configured to:

determine the minimum fixing temperature for the recording medium with the page image to a low fixing temperature lower than a predetermined reference fixing temperature when the size judging section judges that the largest value is smaller; or determine the minimum fixing temperature to the reference fixing temperature when the minimum fixing temperature is not determined to the low fixing temperature.

14. The image forming apparatus according to claim 3, further including a size judging section configured to judge whether or not the size value of each of the imaging objects in the page image targeted for image formation is smaller than a predetermined reference size value, wherein the temperature determining section is configured to:

determine the minimum fixing temperature for the recording medium with the page image to a low fixing temperature lower than a predetermined reference fixing temperature when the size judging section judges that the size values of all the imaging objects are smaller; or determine the minimum fixing temperature to the reference fixing temperature when the minimum fixing temperature is not determined to the low fixing temperature.

15. The image forming apparatus according to claim 4, further including a page setting section configured to perform zoom setting or multiple-page layout setting for image formation to be performed in the image forming section, wherein when the zoom setting or the multiple-page layout setting is set on by the page setting section, the temperature determining section corrects the size value of each of the imaging objects in the page image targeted for image formation based on contents set by the page setting section and determines the minimum fixing temperature for the recording medium with the page image.

16. The image forming apparatus according to claim 4, further including a magnification analyzing section configured to analyze contents of magnified character setting settable to a text of the image targeted for image formation, wherein when a drawing object including the text to which the magnified character setting is on is present in the page image targeted for image formation, the temperature determining section corrects the size value of the imaging object including the text targeted for the magnified character setting, among the imaging objects in the page image targeted for image formation, based on the contents of the magnified character setting and determines the minimum fixing temperature for the recording medium with the page image.

17. The image forming apparatus according to claim 5, further including a font analyzing section configured to analyze contents of font setting settable to a text of an image targeted for image formation; and a specified font designating section configured to designate part of font as a specified font requiring fixing at the reference fixing temperature from among fonts settable to the text, wherein when an imaging object including the text to which a font corresponding to the specified font is set is present in the page image targeted for image formation, the temperature determining section determines the minimum fixing temperature for the recording medium with the page image to the reference fixing temperature irrespective of the size value of each of the drawing objects or the size values and the density values.

18. A method for forming an image, including forming a toner image based on image data, transferring the formed toner image to a recording medium, and heating the recording medium to which the toner image has been transferred to fix the toner image, the method including:

an image analyzing step of extracting, from the image data of the image to be formed, at least one of a density value and a size value of each of imaging objects included in the image;

a temperature determining step of determining a minimum fixing temperature for the recording medium transferred with a page image which is an image corresponding to one page of the recording medium to be formed, based on the extracted density values or size values of the imaging objects included in the page image, the temperature determining step including, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger; and a gamma correcting processing step of applying gamma correction to the density values of the imaging objects extracted by the image analyzing section, wherein the image forming step includes forming the toner image based on post gamma correction image data, and the temperature determining section includes determining the minimum fixing temperature for the recording medium with the page image by use of a post gamma correction density value.

19. A non-transitory computer readable medium storing a control program to control an image data processor of an image forming apparatus configured to form a toner image based on image data, transfer the formed toner image to a recording medium, and heat the recording medium having the transferred toner image to fix the toner image to execute:

an image analyzing process of extracting, from the image data of the image to be formed, at least one of a density value and a size value of each of imaging objects included in the image; and a temperature determining process of determining a minimum fixing temperature for the recording medium transferred with a page image which is an image corresponding to one page of the recording medium to be formed, based on the extracted density values or size values of the imaging objects included in the page image, the temperature determining process including, based on the density value or the size value of each of the drawing objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger; and a gamma correcting process of applying gamma correction to the density values of the imaging objects extracted by the image analyzing section, wherein the image forming step includes forming the toner image based on post gamma correction image data, and the temperature determining section includes determining the minimum fixing temperature for the recording medium with the page image by use of a post gamma correction density value.

20. An image forming apparatus including:

an image forming section configured to form a toner image based on image data and transfer the formed toner image to a recording medium;

a fixing section configured to heat the recording medium to which the toner image has been transferred in the image forming section to fix the toner image;

an image analyzing section configured to extract, from the image data of the image to be formed in the image forming section, at least one of a density value and a size value of each of imaging objects included in the image;

a temperature determining section configured to determine a minimum fixing temperature of the fixing section for the recording medium transferred with a page image which is an image corresponding to one page of the recording medium to be formed in the image forming section, the minimum fixing temperature being determined based on the extracted density values or size values of the imaging objects included in the page image, the temperature determining section is configured to perform, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger;

a font analyzing section configured to analyze contents of font setting settable to a text of an image targeted for image formation; and a specified font designating section configured to designate part of font as a specified font requiring fixing at the reference fixing temperature from among fonts settable to the text, wherein when an imaging object including the text to which a font corresponding to the specified font is set is present in the page image targeted for image formation, the temperature determining section determines the minimum fixing temperature for the recording medium with the page image to the reference fixing temperature irrespective of the size value of each of the drawing objects or the size values and the density values.

21. A method for forming an image, including forming a toner image based on image data, transferring the formed toner image to a recording medium, and heating the recording medium to which the toner image has been transferred to fix the toner image, the method including:

an image analyzing step of extracting, from the image data of the image to be formed, at least one of a density value and a size value of each of imaging objects included in the image;

a temperature determining step of determining a minimum fixing temperature for the recording medium transferred with a page image which is an image corresponding to one page of the recording medium to be formed, based on the extracted density values or size values of the imaging objects included in the page image, the temperature determining step including, based on the density value or the size value of each of the imaging objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger;

a font analyzing step of analyzing contents of font setting settable to a text of an image targeted for image formation; and a specified font designating step of designating a part of font as a specified font requiring fixing at the reference fixing temperature from among fonts settable to the text, wherein when an imaging object including the text to which a font corresponding to the specified font is set is present in the page image targeted for image formation, wherein the temperature determining step determines the minimum fixing temperature for the recording medium with the page image to the reference fixing temperature irrespective of the size value of each of the drawing objects or the size values and the density values.

22. A non-transitory computer readable medium storing a control program to control an image data processor of an image forming apparatus configured to form a toner image based on image data, transfer the formed toner image to a recording medium, and heat the recording medium having the transferred toner image to fix the toner image to execute:

an image analyzing process of extracting, from the image data of the image to be formed, at least one of a density value and a size value of each of imaging objects included in the image; and a temperature determining process of determining a minimum fixing temperature for the recording medium transferred with a page image which is an image corresponding to one page of the recording medium to be formed, based on the extracted density values or size values of the imaging objects included in the page image, the temperature determining process including, based on the density value or the size value of each of the drawing objects in the page image, at least one of setting the minimum fixing temperature to be lower when a highest one of the density values is lower than when the highest one of the density values is higher, and setting the minimum fixing temperature to be lower when a largest one of the size values is smaller than when the largest one of the size values is larger;

a font analyzing process of analyzing contents of font setting settable to a text of an image targeted for image formation; and a specified font designating process of designating part of font as a specified font requiring fixing at the reference fixing temperature from among fonts settable to the text, wherein when an imaging object including the text to which a font corresponding to the specified font is set is present in the page image targeted for image formation, wherein the temperature determining process determines the minimum fixing temperature for the recording medium with the page image to the reference fixing temperature irrespective of the size value of each of the drawing objects or the size values and the density values.

* * * * *